US005311939A

United States Patent [19]

Pringle et al.

[11] Patent Number: 5,311,939

[45] Date of Patent: May 17, 1994

[54] MULTIPLE USE WELL PACKER

[75] Inventors: Ronald E. Pringle, Houston; Arthur J. Morris, Magnolia, both of Tex.

[73] Assignee: Camco International Inc., Houston, Tex.

[21] Appl. No.: 914,402

[22] Filed: Jul. 16, 1992

[51] Int. Cl.[5] ..... E21B 23/06

[52] U.S. Cl. ..... 166/134; 166/138; 166/216; 166/240; 166/331

[58] Field of Search ..... 166/134, 138-140, 166/216, 240, 331

[56] References Cited

U.S. PATENT DOCUMENTS

| | | | |
|---|---|---|---|
| 3,507,327 | 4/1970 | Chenoweth | 166/139 X |
| 3,520,361 | 7/1970 | Lewis | 166/138 X |
| 3,603,392 | 9/1971 | McGill | 166/240 X |
| 3,705,624 | 12/1972 | Pitts | 166/140 X |
| 3,710,866 | 1/1973 | Pitts | 166/140 X |
| 3,741,304 | 6/1973 | McGill | 166/216 |
| 3,744,563 | 7/1973 | McGill | 166/140 X |
| 4,018,274 | 4/1977 | Cochran | 166/138 X |
| 4,071,084 | 1/1978 | Brown et al. | 166/139 X |
| 4,671,354 | 6/1987 | Henderson et al. | 166/134 |
| 4,844,154 | 7/1989 | Ross et al. | 166/139 |
| 5,086,839 | 2/1992 | Setterberg, Jr. et al. | 166/138 |

*Primary Examiner*—Ramon S. Britts
*Assistant Examiner*—Roger J. Schoppel
*Attorney, Agent, or Firm*—Fulbright & Jaworski

[57] ABSTRACT

A well packer for engaging and sealing against the inside of a conduit having a mandrel, friction blocks, slips, and a packer seal. The friction blocks are supported by the mandrel and positioned parallel to the slips providing a short inexpensive packer. The packer can be quickly and easily converted to be either a mechanical set bi-directional packer, a compression set well packer, or a tension set packer.

7 Claims, 8 Drawing Sheets

Fig. 10
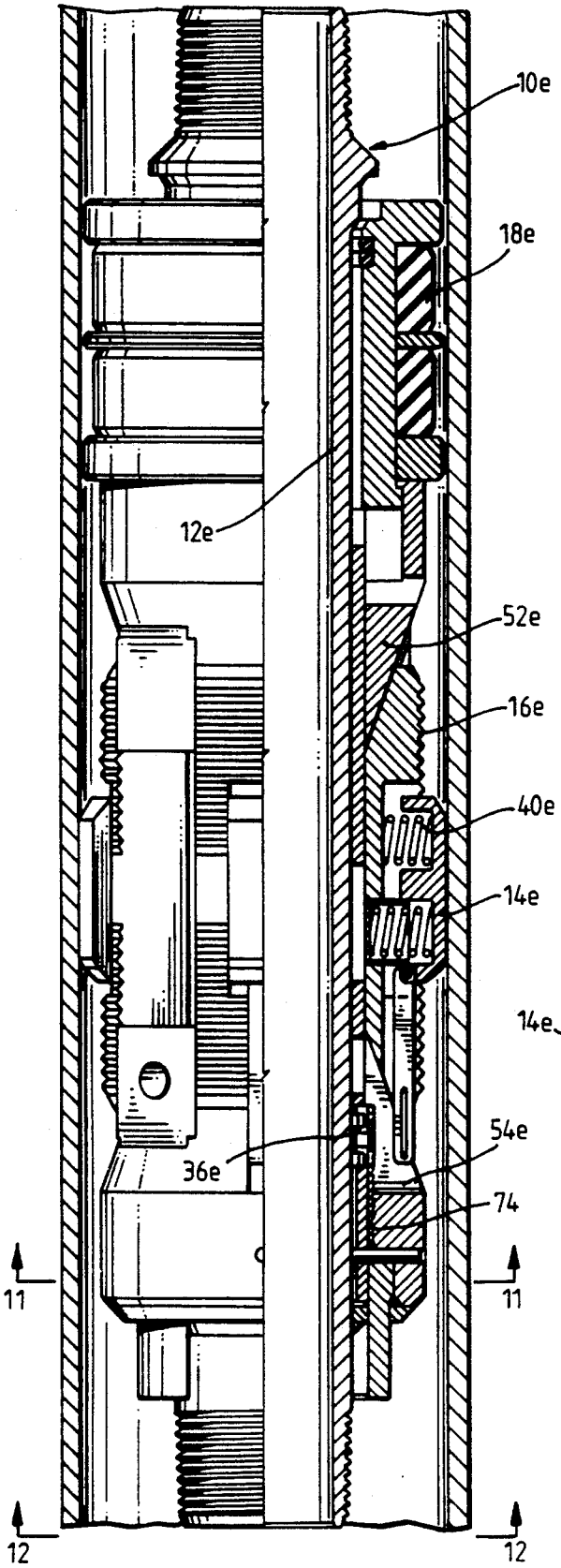
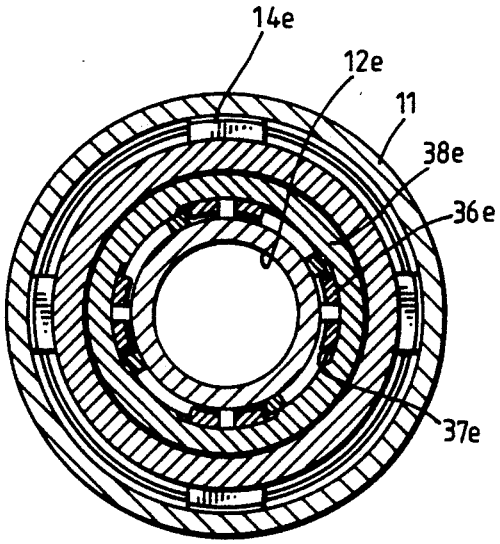
Fig. 11
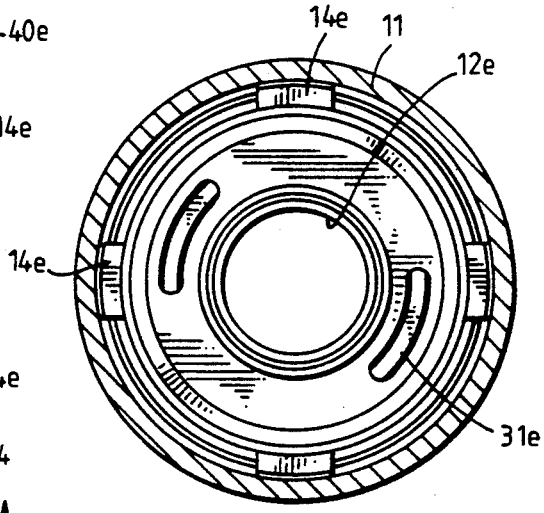
Fig. 12

Fig. 14A
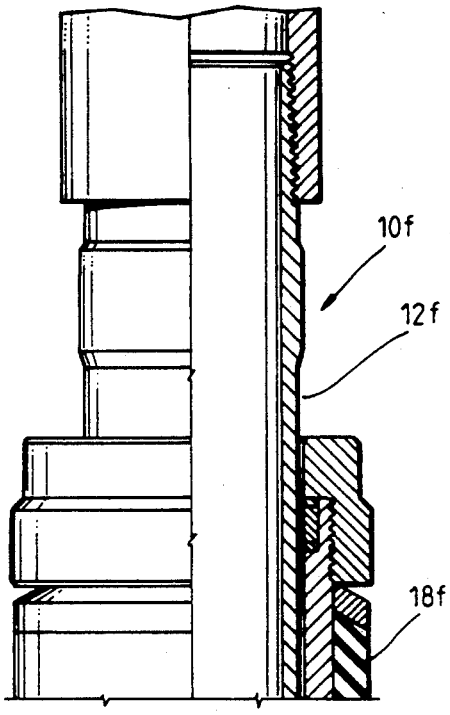
Fig. 14B
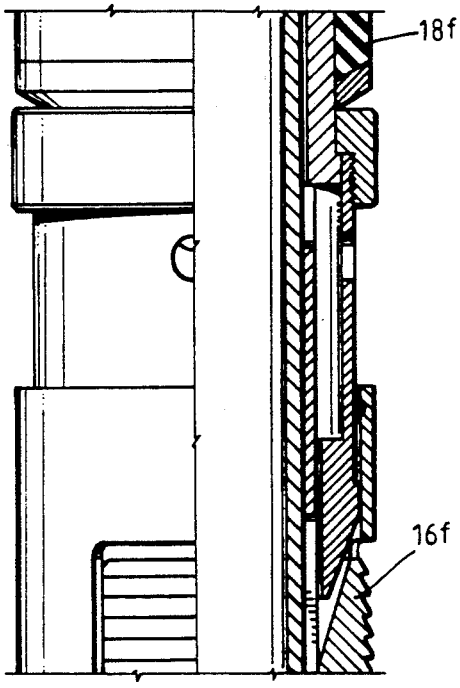
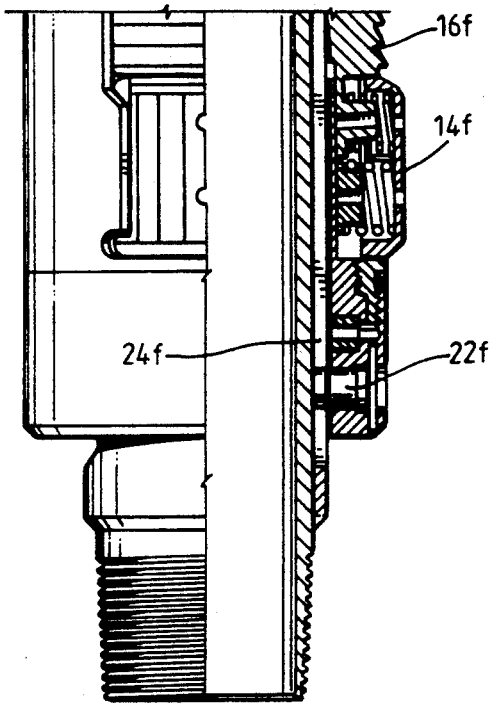
Fig. 14C

MULTIPLE USE WELL PACKER

BACKGROUND OF THE INVENTION

The present invention is directed to a well packer that can be utilized as a compression set, a tension set, or a bi-directional packer by simply adding, subtracting or moving components to create the various version desired.

It is well known to provide a well packer which is generally used to isolate and seal off production fluids from an oil and/or gas well between the outer casing and production tubing. However, during the life of an oil or gas field, production requirements can range from the initial flowing, to artificial lift, and include pressure maintenance by the injection of water and/or gases. Each of these phases can require separate and unique features of a well packer. For example, initially free flowing completions ideally use a bi-directional packer. However, when the reservoir pressure declines, artificial lift is required to maintain production. A weight set compression packer is used in wells for this purpose if the producing interval is deep enough to allow sufficient pipe weight to affect and maintain a packer seal. In shallow applications, a tension set packer is the ideal selection if pipe weight is not sufficient to affect and maintain a packer seal by compression.

SUMMARY

One of the objects of the present invention is the provision of a mechanical set well packer that can be utilized as a compression set, a tension set, or a bi-directional well packer by adding, subtracting or moving components to create the various type packers desired. It is further desired that the packers be mechanically set and released by right hand rotation for avoiding disconnecting any tubing joints.

A further object of the present invention is to provide a mechanically set bi-directional packer which holds mechanical integrity in both directions as well as pressure and in which the packer includes rotary locking and unlocking means for locking the packer in a set position and for unlocking the packer for release.

Yet a still further object of the present invention is wherein the bi-directional packer may be converted to a mechanical set compression set packer by removing the locking means and holding the packer set in place by compression tubing weight.

Yet a still further object of the present invention is to convert the mechanical set bi-directional packer to a tension set packer by removing the unlocking means, running the packer in the well upside down and adjusting a guide pin to a selected slot that is configured to insure right hand rotation for setting the upside down packer.

Still a further object of the present invention is the provision of a well packer for engaging and sealing against the inside of a conduit which includes a support mandrel, friction blocks carried by the mandrel for engaging the conduit for allowing setting of the packer by movement of the mandrel, slip means carried by the mandrel for outward movement into engagement with the inside of the conduit for holding the packer, sealing means carried by the mandrel for outward movement into a sealing relationship with the conduit. The friction blocks are preferably supported by the mandrel in parallel to the slip means.

Still a further object of the present invention is wherein the friction blocks are urged outwardly by first and second springs and at least one of the springs extends through the slip means for engaging the mandrel without pressing on the slip means.

Yet a further object of the present invention is wherein the well packer includes first and second slots positioned on the outer circumference of the mandrel and a pin is connected to the slip means and is alternately engagable with either of the slots. The first slot is arranged for right hand rotation of the mandrel for setting the well packer and the second slot is arranged for right hand rotation of the mandrel for setting the well packer when the packer is set upside down. Therefore, the packer can be used as either a compression set or a tension set type packer.

Yet still a further object is the provision of a well packer which includes locking and unlocking mechanism for locking and unlocking the packer which includes ratchet means and locking means around the mandrel and means rotatable relative to the ratchet means and the locking means for setting and unsetting the ratchet means and the locking means. In one embodiment the mandrel includes a groove on the outside for receiving the locking means and the rotatable means includes an opening and a backup shoulder for coacting with the ratchet means and the locking means for alternately setting and unsetting both the ratchet means and the locking means.

Still a further object of the present invention is a packer which includes a sealing means body outside of the mandrel supporting the sealing means and ratchet means between the body and said mandrel in which the ratchet means is movable radially between the body and the mandrel for setting and unsetting the packer.

A still further object of the present invention is the provision of a locking and unlocking mechanism for use in a well packer having a ratchet means positioned on the mandrel for radial movement inwardly and outwardly and rotatable means are connected to the mandrel and movable relative to the ratchet means for controlling the radial position of the ratchet means. In one embodiment the ratchet means is positioned between the mandrel and the remote wedge means. In another embodiment the ratchet means is positioned between a sealing means body and the mandrel.

Yet still a further object of the present invention is the provision of a locking and unlocking mechanism for locking and unlocking a well packer which includes a circular housing surrounding the mandrel, a plurality of locking dogs and a plurality of ratchets in the housing and positioned for radial movement. A rotatable member surrounds the housing and is connected to the mandrel and the member includes openings and backup shoulders for controlling the radial position of the dogs and ratchets.

Other and further objects, features and advantages will be apparent from the following description of presently preferred embodiments of the invention, given for the purpose of disclosure, and taken in conjunction with the accompanying drawings.

BRIEF DESCRIPTION OF THE DRAWINGS

FIG. 10 is an elevational view, in quarter section, of another embodiment of a mechanically set bi-directional packer, FIG. 11 is a cross-sectional view taken along the lines 11—11 of FIG. 10, FIG. 12 is an end view taken along the line 12—12 of FIG. 10.

DESCRIPTION OF THE PREFERRED EMBODIMENTS

Figure 1:
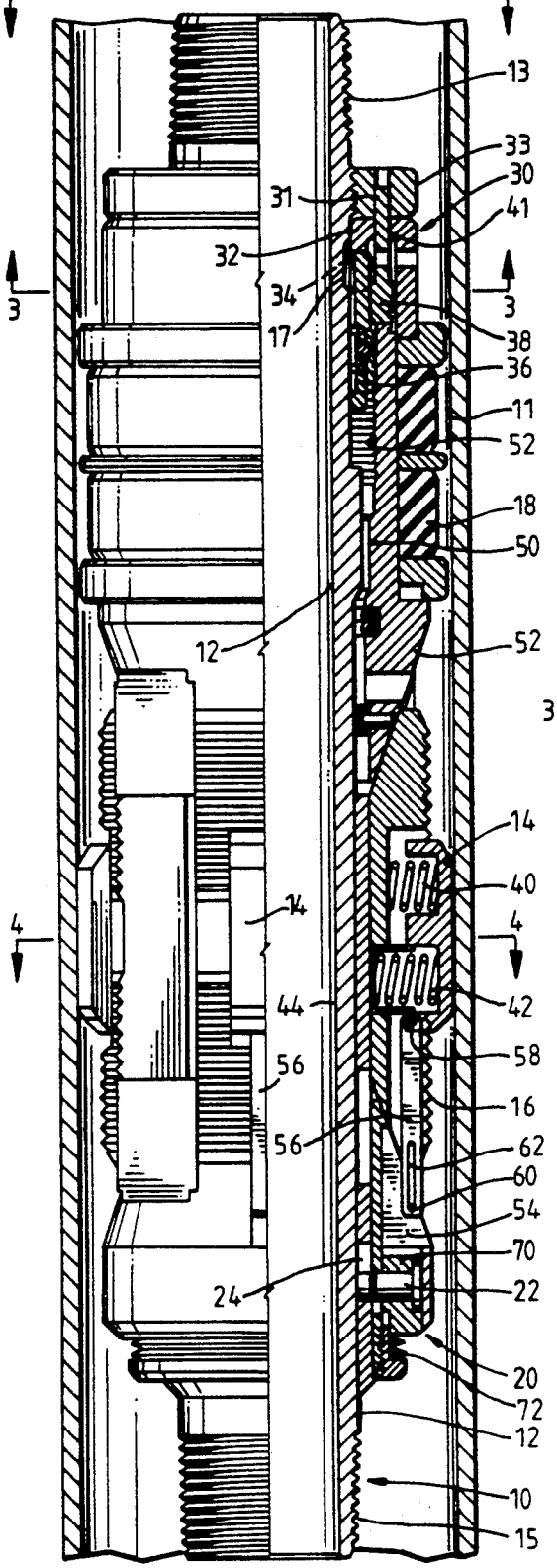
FIG. 1 is an elevational view, in quarter section, of a mechanical set bi-directional well packer of the present invention.
Figure 2:
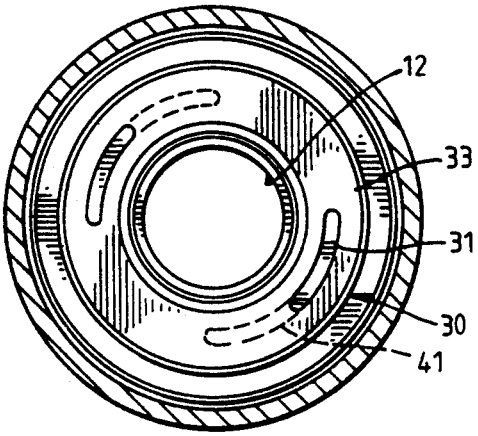
FIG. 2 is an end view taken along the line 2—2 of FIG. 1.

Referring now to the drawings and particularly to FIGS. 1-5, the numeral 10 generally indicates the well packer of the present invention which generally includes a support mandrel 12, a plurality of friction blocks 14, slip means such as a plurality of slips 16, and packer sealing means 18. In addition, a pin and slot arrangement generally indicated by the reference 20 is provided, and a locking and unlocking mechanism generally indicated by the reference 30 is provided.

The mandrel 12 generally includes connecting means at each end such as threads 13 and 15 for connection to production tubing in an oil and/or gas well. The packer is mechanically actuated by longitudinal and rotational motion of the mandrel 12 for engaging and sealing against the inside of a conduit 11 such as well casing.

Figure 4:
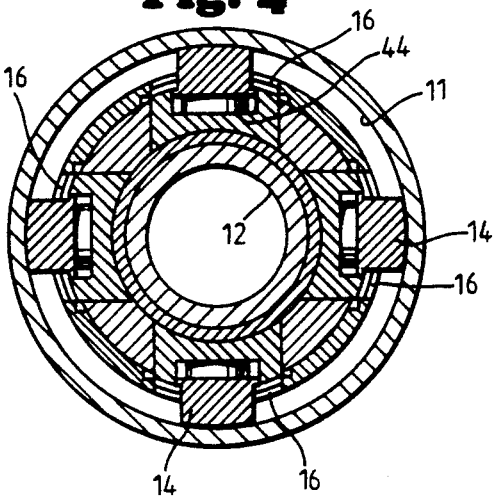
FIG. 4 is a cross-sectional view taken along the line 4—4 of FIG. 1.

It is conventional to provide well packers having friction blocks, slips, and packing seal means positioned on a mandrel. As best seen in FIGS. 1 and 4, each individual friction block 14 is placed within one of the slips 16. By being in parallel with the slips 16 the friction blocks 14 reduce the required length of the packer 10. The friction blocks 14 are drag blocks which engage the inside of the casing wall 11 in order to obtain manipulation of the various components relative to manipulation of the mandrel 12. In order to accomplish this the friction blocks are yieldably urged outwardly into engagement with the wall of the casing 11 by one or more springs such as springs 40 and 42. It is to be noted that spring 40 acts between a slip 16 and a friction block 14 while spring 42 acts between the friction block 14 and the outer circumference of the mandrel 12 through a spring cap 44. This structure shown in FIGS. 1 and 4 advantageously reduces the spring force which the slips 16 are required to overcome in order to bite into the wall of the casing 11, but still provide sufficient spring force biasing the friction blocks 14 into engagement with the casing 11. The friction blocks 14 must frictionally engage the casing 11 with enough friction for allowing the slip 16 to be actuated. Of course, if desired, both of the springs 40 and 42 could extend through the slips 16 and against the mandrel 12 similarly to the spring 42 in order to avoid any spring pressure restraining the slips 16.

Figure 6:
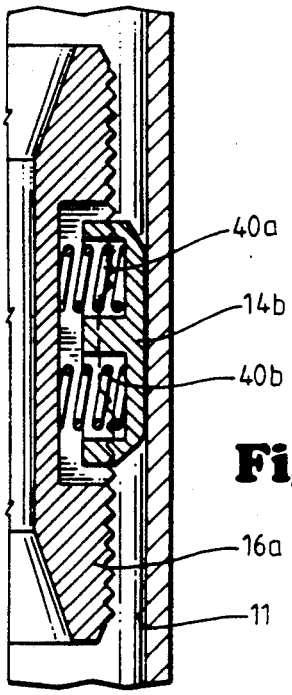
FIG. 6 is another embodiment of positioning the friction blocks in the slips.
Figure 13:
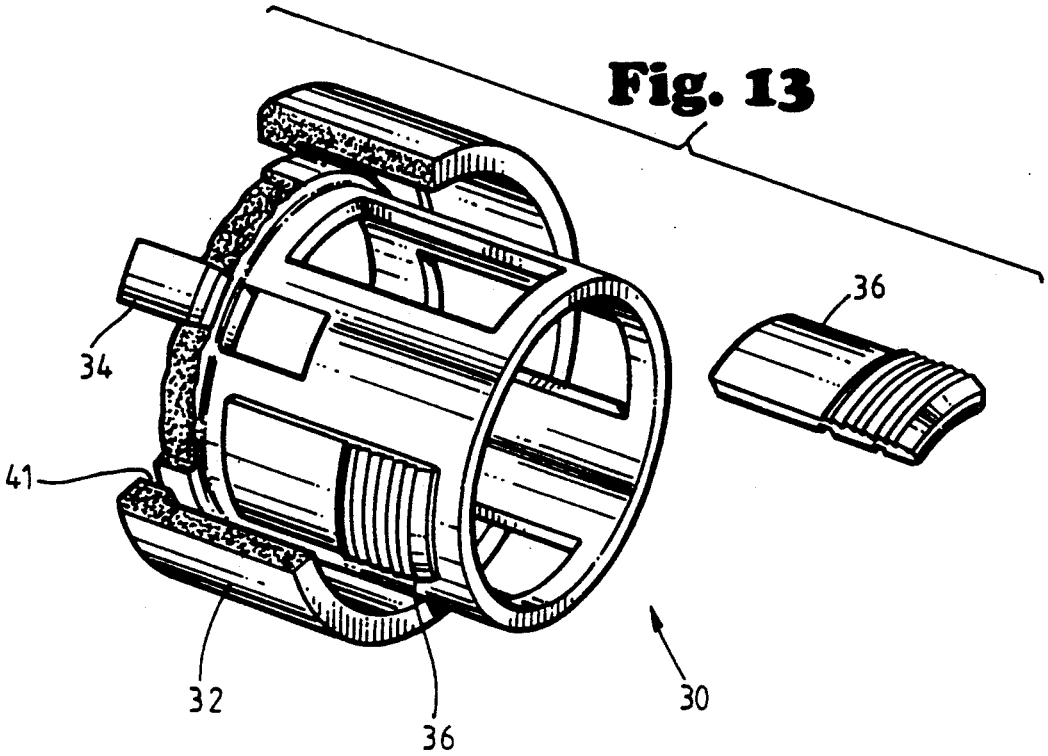
FIG. 13 is an exploded perspective view, partly in section, illustrating part of the locking and unlocking mechanism of FIG. 1, FIGS. 14A, 14B, and 14C are continuations of each other and form a schematic elevational view, in cross section, of still a further embodiment of the present invention.
Figure 7:
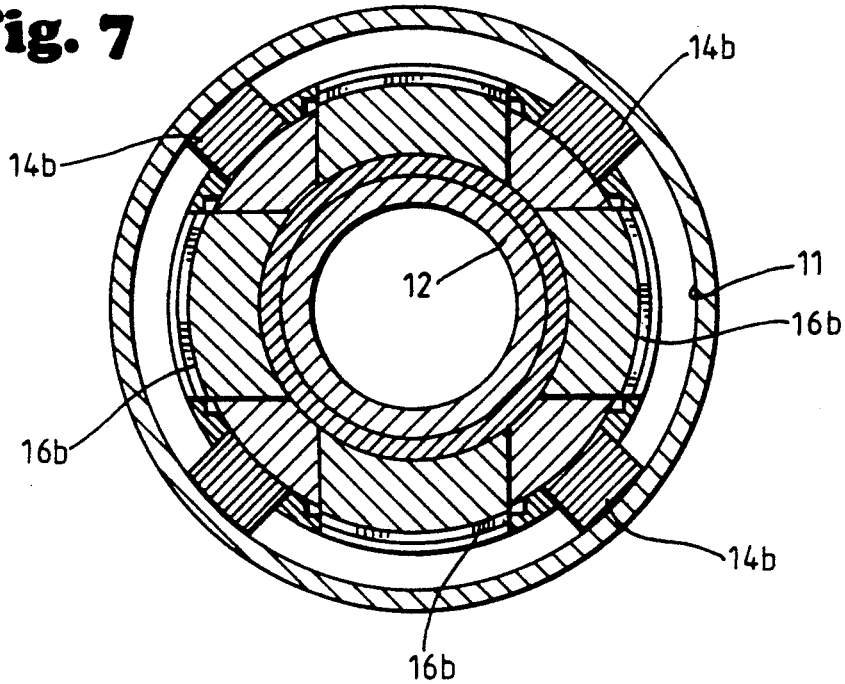
FIG. 7 is a cross-section of another embodiment of placing the friction blocks alternately between and parallel with the slips.

As an alternate embodiment, and referring to FIG. 6, friction blocks 14*b* can be acted upon by springs 40*a* and 40*b* in which all of the springs 40*a* and 40*b* are positioned between the friction block 14*a* and slips 16*a*. In still a further embodiment, as best seen in FIG. 7, the friction blocks 14*b* are positioned between adjacent slips 16*b* and thus the friction blocks 14*b* are still parallel to the slips 16*b*.

Referring again to FIG. 1, a sealing means body 50 is provided outside of the mandrel 12 for supporting the packer seal means 18 and is connected to a wedge 52 at one end of the slips 16 for driving the slips 16 outwardly into engagement with the inside wall of the casing 11 as the mandrel 12 is moved downwardly relative to the friction blocks 14. A second wedge means 54 is positioned at the other end of the slips 16 for coacting with the slips 16 for providing outward movement of the slips 16. The wedge 54 is connected to the friction block 14 by a connection which allows relative movement of the wedge 54 and friction blocks 14 together, but limits the movement of the wedge means 54 away from the friction blocks 14. Such a connection may be an arm 56 pivotly connected by pin 58 at one end to the friction blocks 14 and the second end of the arm 56 is connected to the wedge 54 through a pin 60 slidably in an opening 62 in the arm 56.

Figure 5A:
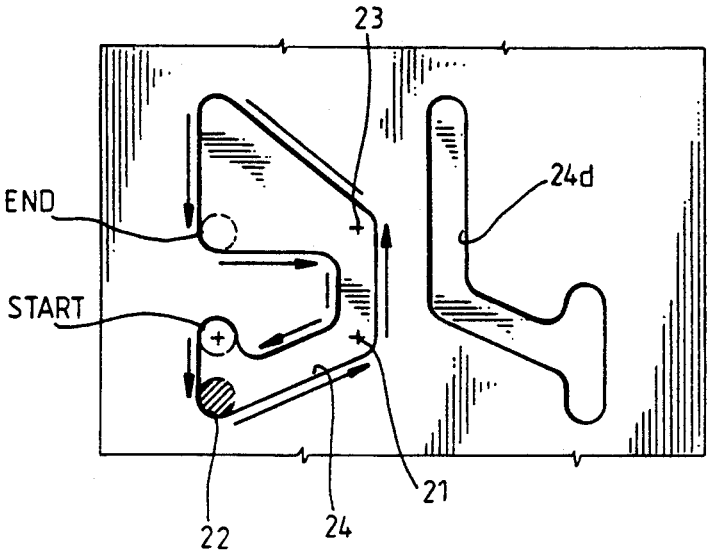
FIG. 5A is a development layout of first and second J slots positioned in the packer of FIG. 1 when used as a compression set packer.
Figure 5B:
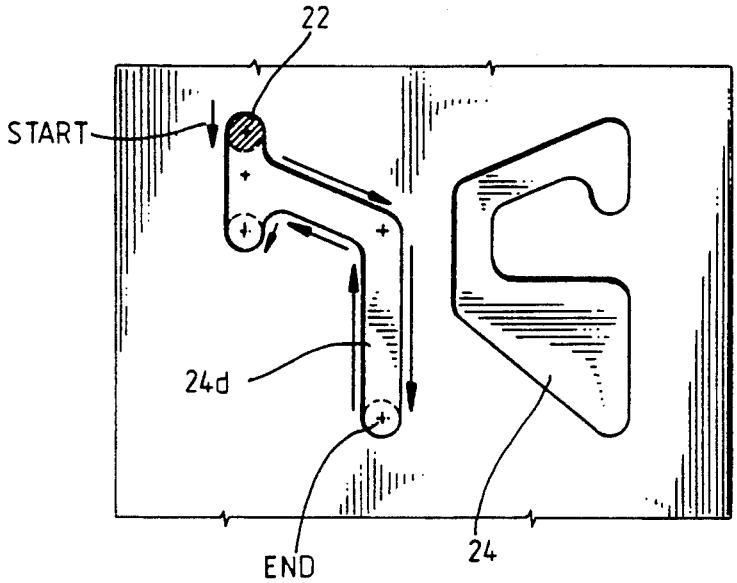
FIG. 5B is a development layout of the first and second J slots of FIG. 5A when used as a tension set packer.

In order to prevent the packer 10 from inadvertently setting as it is moved downhole through the casing 11, the pin and slot assembly 20 includes a pin 22 movable in a conventional J slot 24, as best seen in FIGS. 1 and 5A. Such J slots 24 are designed to allow manipulation and actuation of the well packer 10 without imparting a left handed rotation to the production string. The slot 24 is in the outer periphery of the mandrel 12 and initially the position of the pin 22 is as indicated at START at which time the parts of the mandrel are locked against rotational movement. When the packer 10 is at the desired location in the casing 11 the packer and thus the mandrel 12 and thus the slot 24 are longitudinally raised moving the slot 24 upwardly relative to the pin 22. Thereafter, the mandrel is rotated to the right along with the J slot 24 thereby moving the pin 22 to a position 21 whereby the mandrel may be moved downwardly with the slot 24 moving downward relative to the pin 22 and the friction blocks 14 for setting the well packer 10.

Another feature of the present invention is the locking and unlocking mechanism 30 which allows locking and unlocking of the set packer relative to the mandrel 12 by rotation thereby allowing the packer to be kept as short as possible. In addition, the locking and unlocking mechanism 30 is actuated in a space between the seal body 50 and the mandrel 12 for again reducing the length requirements of the packer.

Figure 3:
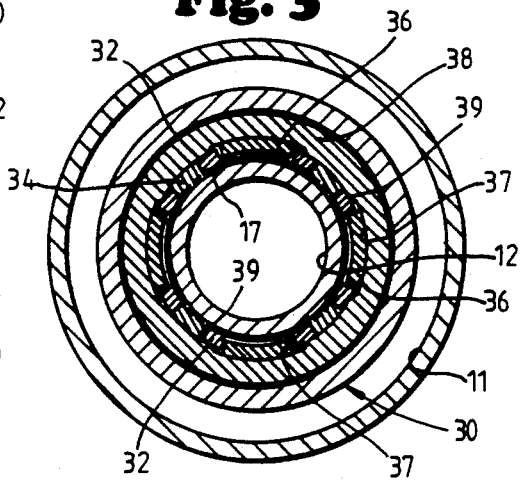
FIG. 3 is a cross-sectional view taken along the line 3—3 of FIG. 1.

Referring now to FIGS. 1, 2, 3 and 13, the locking and unlocking mechanism is best seen and generally includes a circular housing 32 containing a plurality of dogs 34 and spring loaded outwardly biased ratchets 36. A rotatable member 38 (not shown in FIG. 13) surrounds and is rotatable relative to the circular housing 32. The member 38 includes on its inner periphery alternately openings 37 and backup shoulders 39 which are rotatable over the dogs 34 and the ratchets 36. The rotatable member 38 includes a tongue 31 secured to a knob 33 which in turn is threadably connected to the mandrel 12. Thus, the rotatable member 38 rotates with rotation of the mandrel 12 and the J slot 24. However, the circular housing 32 includes arcuate slot 41 (FIGS. 1 and 2) for allowing the rotatable member 38 to rotate relative to the housing 32 and the dogs 34 and ratchets 36. In addition, as best seen in FIGS. 1 and 3, the mandrel 12 includes a locking groove 17 in its outer circumference.

The locking and unlocking mechanism 30 is shown in the locked position in FIG. 3. That is, the backup shoulders 39 are positioned engaging the dogs 34 locking them in the groove 17 in the mandrel 12. At the same time the openings 37 are aligned with the ratchets 36 allowing the outwardly biased spring loaded ratchets 36 to be moved outwardly and enable them to be locked against the rachet teeth 52 on the backside of the seal body 50. However, if the rotatable member 38 is rotated, in the present example 45°, the openings 37 are aligned with the dogs 34 allowing them to be retracted from the mandrel groove 17 and at the same time the backup shoulders 39 push the ratchets 36 downwardly away from engagement with the teeth 52.

In use, the bi-directional packer 10 is positioned as best seen in FIGS. 1–4, and 5A with the dogs 34 locked in the groove 17 by the rotatable member 38 and the pin 22 locked in the START position (FIG. 5A) of slot 24 preventing rotation of the mandrel 12 relative to the other components. The packer 20 is moved downhole through the casing 11 to the desired setting location. Upward movement of the production string and mandrel 12 moves the pin 22 to the bottom of the J slot 24 (FIG. 5A) and right-hand rotation of the mandrel 12 moves the pin 22 to position 21 and at the same time rotates the rotatable member 38 to an unlocking position relative to the dogs 34. Downward movement of the mandrel 12 moves the wedges 52 and 54 together causing the slip 16 to engage the inside of the casing 11 and the teeth which may be any suitable type, such as buttress type, will hold in both directions. Further downward movement against the now set slips 16 will move the locking and unlocking mechanism 30 downwardly relative to the packer means 18 for expanding and setting the packer into a sealing relationship with the inside of the conduit 11 and at the same time will cause the ratchets 36 to engage the teeth 52 on the underside of the body 50. Further downward movement of the mandrel 12 and the J slot 21 will now rotate the pin 22 and a rotatable member 38 to the position shown in FIG. 3 for locking the dogs 34 and ratchets 36 in the expanded position to hold the packer in the set position. Clutch 70 and spring 72 allow pin 22 to move from position 23 to above the END position. Packer 10 may then be lifted up moving the pin 22 to its END position in slot 24 (FIG. 5).

To unseat the packer 10, it is rotated to the right to bring the pin 22 to position 23 which unlocks the rotatable member 38 from behind the dogs 34 and ratchets 32, mandrel 12 is lifted allowing the downward movement of the pin 22 relative to the J slot 24 and the release of the seal means 18 and slip 16 and the packer 10 is retrieved.

Figure 8:
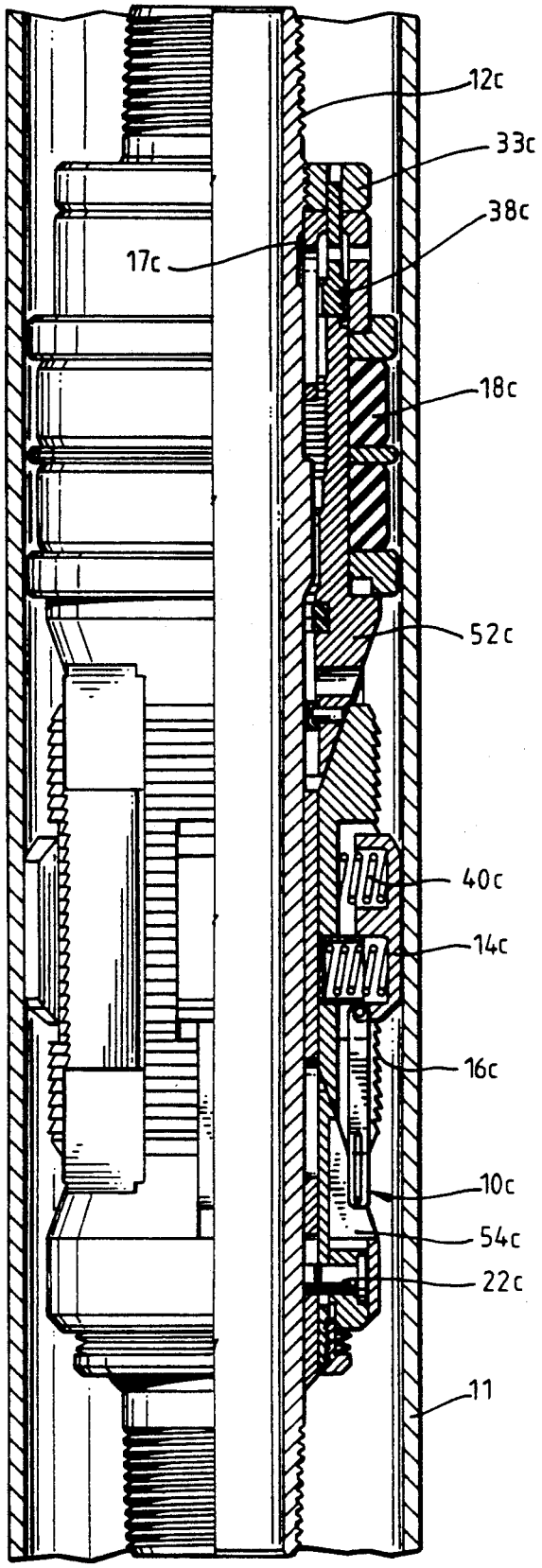
FIG. 8 is an elevational view, in quarter section, of the packer of FIG. 1 modified for use as a compression set well packer.

However, it is desired to perform multiple uses with the packer 10 of FIGS. 1–7. Referring now to FIG. 8, the packer **10*c* is the same as the packer in FIG. 1 with the exception that the dogs 34 and the ratchets 36 have been omitted and the teeth on the slips 16*c* have been substituted to insure that they grip into the interior of the casing 11 when they are set with a downward compression force. The packer 10*c* in which the parts similar to that illustrated in FIG. 1 are similarly numbered with the addition of the suffix "c". The packer 10*c* now operates as a compression set well packer. The packer 10*c* holds pressure in both directions, but instead of being locked in position as packer 10 of FIG. 1, is held in place by compression tubing weight. The packer 10*c* uses the same J slot 24 for setting and release of the compression tubing weight releases the packer 10*a* for straight pull retrieval. However, the packer 10*c* cannot be separated from the production tubing and left in the casing 11 as can the packer 10 of FIG. 1**.

Figure 9:
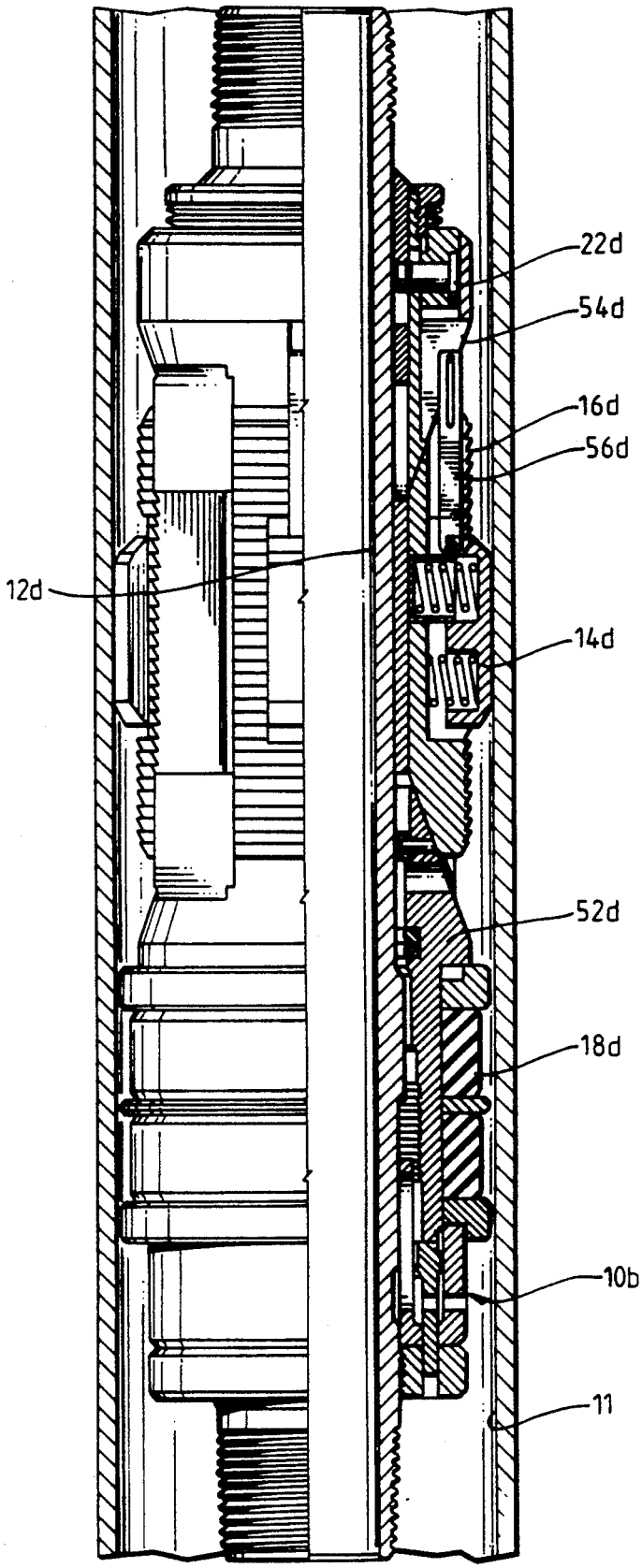
FIG. 9 is an elevational view, in quarter section, of packer of FIG. 1 being inverted and modified to be a tension set packer.
Figure 15:
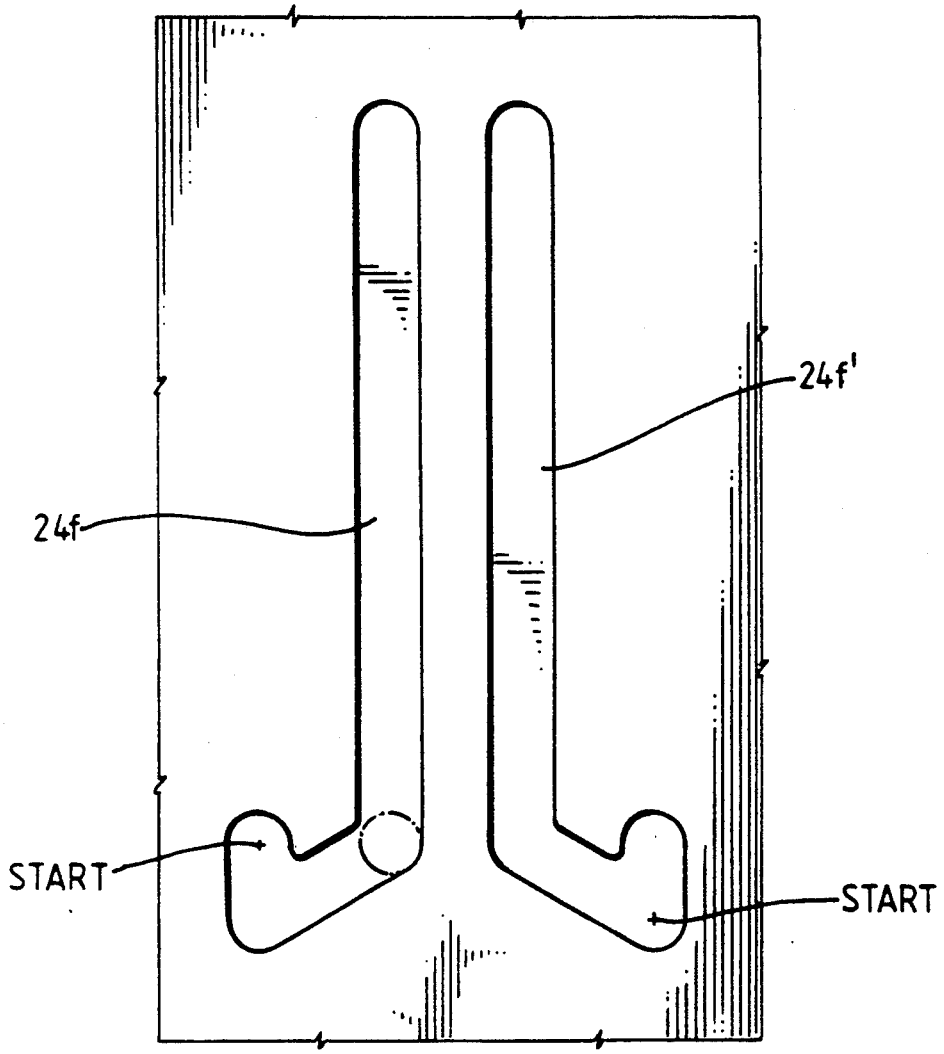
FIG. 15 is a development layout of first and second J slots of the packer shown in FIGS. 14A, 14B and 14C.

Referring now to FIG. 9, a tension set packer **10*d* is shown which is the same packer as packer 10 shown in FIG. 1 with the exception that the dogs 34, and ratchets 36 have been removed, the teeth on the slips 16*d* have been changed to grip into the casing 11 upon an upward pull. In addition, the pin 22 has been removed from the slot 24 and inserted into a J slot 24*d* on the mandrel 12*d* for allowing the setting of the packer 10*d* by right-hand rotation. With these changes the packer 10*d* operates mechanically just as the compression set packer 10*a*. However, the packer 10*b* is run into the casing 11** upside down.

The J slot **24*d* was not utilized in the embodiment of FIGS. 1–7 and 5A. The J slot 24 is not utilized in the operation of the embodiment of FIG. 9. Referring now to FIGS. 5A and 5B, the slot 24*b* is shown in development and is preferably placed in the mandrel 12 in FIG. 1 circumferentially offset from the J slot 24. When converting the packer 10 to the packer 10*b* of FIG. 9, the pin 22 is removed from the J slot 24 and inserted into the J slot 24*d* at the START position (FIG. 5B). In setting the packer 10*d* the mandrel 12*d* is raised slightly and rotated to the right, and then lifted by tension to set the packer 10*d* and the pin 22 ends up at the END position. Otherwise, the parts indicated in FIG. 9 are the same as the parts in FIG. 1** and like parts are similarly numbered with the addition of the suffix "d".

Referring now to FIGS. 10, 11 and 12, another embodiment of a compression set bi-directional well packer is best seen. The packer **10*e* is similar to packer 10 shown in FIG. 1 and like parts are similarly numbered with the addition of the suffix "e". The packer 10*e* differs from the packer 10 in that the dogs are omitted and the locking and unlocking mechanism 30*e* (containing only the ratchets 36*e*) are moved to be positioned between the wedge 54*e* and the mandrel 12*e*. At this position the rachet 36*e* engages teeth 74 on the underside of the wedge 54*e*. In this position, the rachet can be made larger than the rachet in FIG. 1 and thus have greater strength. Again, the operation of packer 10*e* is similar to packer 10** in requiring a right-hand rotation and downward movement for setting and a right rotation and upward movement for release.

Referring now to FIGS. 14A, 14B, 14C and 15, a further embodiment of a packer is shown, wherein like parts to packer 10 are similarly numbered with the addition of the suffix "f". Packer 10*f* is not a bi-directional packer, but is a simple, short and inexpensive packer which can be used as a compression set or a tension set packer. The packer 10*f* includes mandrel 12*f*, friction blocks 14*f*, slip means 16*f*, packer sealing means 18*f*, pin 22*f* and J-slots 24*f* and 24*f'*. In the position shown in FIGS. 14A, 14B and 14C, the packer 10*f* is shown as a compression set packer with the pin 22*f* positioned at START in J-slot 24*f*. The packer 10*f* is set by first lifting up the mandrel 12*f*, rotating the mandrel to the right, moving the mandrel downwardly setting the slip means 16*f* and the packer sealing means 18*f*. To utilize the packer 10*f* as a tension set packer, the pin 22*f* is moved from J-slot 24*f* to J-slot 24*f'* and the packer is run into the well upside down (slot 24*f'* will then be upside down to the development shown in FIG. 15). The tension set mode is set by first setting down the mandrel 12*f* to move the pin 22*f* out of the START position in slot 24*f'*, rotating the mandrel 12*f* to the right, moving the mandrel upwardly setting the slip means 16*f* and the packer sealing means 18*f*.

The present invention, therefore, is well adapted to carry out the objects and attain the ends and advantages mentioned as well as others inherent therein. While presently preferred embodiments of the invention have been given for the purpose of disclosure, numerous changes in the details of construction, and arrangement of parts, will readily suggest themselves to those skilled in the art and which are encompassed within the spirit of the invention and the scope of the appended claims.

What is claimed is:

1. A well packer for engaging and sealing against the inside of a conduit comprising, a support mandrel, friction blocks carried by the mandrel for engaging the conduit for allowing setting of the packer by movement of the mandrel, slip means having a plurality of outwardly directed teeth, said slip means carried by the mandrel for outward movement into engagement with the inside of the conduit for holding the packer, sealing means carried by the mandrel for outward movement into a sealing relationship with the conduit, and the friction blocks are positioned within the outwardly directed teeth of the slip means.

2. The well packer of claim 1 wherein the friction blocks are urged outwardly by first and second springs and at least one of the springs extends through an opening in said slip means and engages the mandrel without pressing on the slip means.

3. A well packer for engaging and sealing against the inside of a conduit comprising, a support mandrel, friction blocks carried by the mandrel for engaging the conduit for allowing setting of the packer by movement of the mandrel, slip means carried by the mandrel for outward movement into engagement with the inside of the conduit for holding the packer, sealing means carried by the mandrel for outward movement into a sealing relationship with the conduit, first and second slots positioned on the outer circumference of the mandrel, a pin connected to the slip means, said pin alternately engageable with either of the slots, the first slot being arranged for right hand rotation of the mandrel for setting the well packer, and the second slot being arranged for right hand rotation of the mandrel for setting the well packer when the packer is set upside down.

4. A well packer for engaging and sealing against the inside of a conduit comprising, a support mandrel, friction blocks carried by the mandrel for engaging the conduit for allowing setting of the packer by movement of the mandrel, slip means carried by the mandrel for outward movement into engagement with the inside of the conduit for holding the packer, sealing means carried by the mandrel for outward movement into a sealing relationship with the conduit, a locking and unlocking mechanism for locking and unlocking the packer comprising, spring loaded ratchet means and dog locking means positioned around the mandrel and carried in a circular housing, a rotatable member rotatable relative to the housing, rotatable to the ratchet means, and rotatable to the locking means for locking and unlocking the packer when set, and said mandrel includes a groove on the outside for receiving the dog locking means, and the rotatable member includes a circular spaced opening and a backup shoulder for coacting with the ratchet means and the dog locking means for alternatively setting and unsetting both the ratchet means and the dog locking means.

5. The well packer of claim 4 including a sealing means body outside of the mandrel supporting the sealing means, and said ratchet means positioned between the body and the said mandrel thereby reducing the length of the packer.

6. A mechanical set well packer for engaging and sealing against the inside of a conduit comprising, a support mandrel having pipe connecting means at each end, slip means carried by the mandrel for outward movement into engagement with the inside of the conduit for holding the packer against movement in the conduit, wedge means at each end of the slip means for coacting with the slip means for allowing movement of the slip means outwardly and inwardly relative to the mandrel, sealing means adjacent one of the wedge means and carried by the mandrel for outward movement into a sealing relationship with the conduit, and spring loaded friction blocks carried by the mandrel for engaging the conduit for allowing setting of the packer by movement of the mandrel, a first slot positioned on the outer circumference of the mandrel arranged for right hand rotation of the mandrel for setting the well packer right side up, and a pin connected to the remote wedge and engageable with the slot for controlling longitudinal movement between the mandrel and the friction blocks, and a second slot positioned on the outer circumference of the mandrel and adapted to be engaged by said pin, said second slot being arranged for right hand rotation of the mandrel for setting the well packer when the packer is set upside down.

7. The mechanical set packer of claim 6 including a locking and unlocking mechanism for locking and unlocking the packer comprising, a circular housing surrounding the mandrel, a plurality of locking dogs and a plurality of spring loaded ratchets in the housing and positioned for radial movement, said mandrel including a groove on the outside for receiving the locking dogs, and a rotatable member surrounding the housing and connected to the mandrel, said member including circularly spaced openings and backup shoulders for controlling the radial position of the dogs and ratchets.

* * * * *